US009838782B2

(12) United States Patent
Orescanin

(10) Patent No.: US 9,838,782 B2
(45) Date of Patent: Dec. 5, 2017

(54) ADAPTIVE MIXING OF SUB-BAND SIGNALS

(71) Applicant: Bose Corporation, Framingham, MA (US)

(72) Inventor: Marko Orescanin, Framingham, MA (US)

(73) Assignee: BOSE CORPORATION, Framingham, MA (US)

( * ) Notice: Subject to any disclaimer, the term of this patent is extended or adjusted under 35 U.S.C. 154(b) by 23 days.

(21) Appl. No.: 14/672,683

(22) Filed: Mar. 30, 2015

(65) Prior Publication Data

US 2016/0295322 A1 Oct. 6, 2016

(51) Int. Cl.
*H04R 3/00* (2006.01)
*G10L 21/0208* (2013.01)
(Continued)

(52) U.S. Cl.
CPC ..... *H04R 3/005* (2013.01); *G10L 21/0208* (2013.01); *G10L 25/18* (2013.01);
(Continued)

(58) Field of Classification Search
CPC ..... H04R 3/005; H04R 2410/01; H04R 2430/03; G10L 21/0208; G10L 25/18; G10L 2021/02166
(Continued)

(56) References Cited

U.S. PATENT DOCUMENTS 6,049,607 A * 4/2000 Marash ..... H04R 3/005 367/121
6,748,086 B1 * 6/2004 Venkatesh ..... H04M 9/082 381/71.4
(Continued)

FOREIGN PATENT DOCUMENTS

EP 2765787 A1 8/2014
WO 03015464 A2 2/2003
WO 2006117032 A1 11/2006

OTHER PUBLICATIONS

International Search Report and Written Opinion for International Application No. PCT/US2016/024736, dated Jun. 3, 2016, 13 pp.
(Continued)

*Primary Examiner* — William A Jerez Lora
(74) *Attorney, Agent, or Firm* — Patterson + Sheridan, LLP

(57) ABSTRACT

A method includes receiving a first microphone array processing signal (associated with a frequency band that includes a plurality of sub-bands) and receiving a second microphone array processing signal associated with the frequency band. The method includes generating a first output corresponding to a first sub-band based on the first microphone array processing signal and generating a second output corresponding to the first sub-band based on the second microphone array processing signal. The method includes generating a third output corresponding to a second sub-band based on the first microphone array processing
(Continued)

signal and generating a fourth output corresponding to the second sub-band based on the second microphone array processing signal. The method includes performing a first set of microphone mixing operations to generate an adaptive mixer output for the first sub-band and performing a different set of microphone mixing operations to generate another adaptive mixer output for the second sub-band.

20 Claims, 3 Drawing Sheets

(51) Int. Cl.
*G10L 21/0216* (2013.01)
*G10L 25/18* (2013.01)

(52) U.S. Cl.
CPC *G10L 2021/02166* (2013.01); *H04R 2410/01* (2013.01); *H04R 2430/03* (2013.01)

(58) Field of Classification Search
USPC ..... 381/91, 92, 94.2, 94.3, 119, 122
See application file for complete search history.

(56) References Cited

U.S. PATENT DOCUMENTS 8,488,829 B2 7/2013 Ring
8,620,650 B2 12/2013 Walters et al.
8,798,278 B2 8/2014 Isabelle et al.
8,912,522 B2 12/2014 Rubloff et al.
2004/0252852 A1* 12/2004 Taenzer ..... H04R 3/005 381/119
2006/0013412 A1* 1/2006 Goldin ..... H04R 3/005 381/94.1
2006/0227976 A1* 10/2006 Csermak ..... H04R 25/554 381/1
2007/0217629 A1* 9/2007 Zhang ..... H04R 25/405 381/111
2008/0162123 A1* 7/2008 Goldin ..... G10L 19/0204 704/205
2015/0120305 A1* 4/2015 Buck ..... H04R 3/005 704/275
2015/0139446 A1* 5/2015 Tawada ..... G10L 21/0208 381/94.2
2016/0133269 A1* 5/2016 Dusan ..... G10L 15/20 704/233

OTHER PUBLICATIONS

International Preliminary Report on Patentability for Application No. PCT/US2016/024736, dated Oct. 12, 2017.

* cited by examiner

ADAPTIVE MIXING OF SUB-BAND SIGNALS

I. FIELD OF THE DISCLOSURE

The present disclosure relates in general to adaptive mixing of sub-band signals.

II. BACKGROUND

A headset for communicating through a telecommunication system may include one or more microphones for detecting a voice of a wearer (e.g., to be provided to an electronic device for transmission and/or storage of voice signals). Such microphones may be exposed to various types of noise, including ambient noise and/or wind noise, among other types of noise. In some cases, a particular noise mitigation strategy may be better suited for one type of noise (e.g., ambient noise, such as other people talking nearby, traffic, machinery, etc.). In other cases, another noise mitigation strategy may be better suited for another type of noise (e.g., wind noise, with noise caused by air moving past the headset). To illustrate, a "directional" noise mitigation strategy may be better suited to ambient noise mitigation, while an "omnidirectional" noise mitigation strategy may be better suited to wind noise mitigation.

III. SUMMARY

In one implementation, a method includes receiving a first microphone array processing signal associated with a frequency band that includes a plurality of sub-bands. The method includes receiving a second microphone array processing signal associated with the frequency band that includes the plurality of sub-bands. The method includes generating a first output based on the first microphone array processing signal. The first output corresponds to a first sub-band of the plurality of sub-bands. The method includes generating a second output based on the second microphone array processing signal. The second output corresponds to the first sub-band. The method includes generating a third output based on the first microphone array processing signal. The third output corresponds to a second sub-band. The method includes generating a fourth output based on the second microphone array processing signal. The fourth output corresponds to the second sub-band. The method further includes performing a first set of microphone mixing operations to generate a first adaptive mixer output associated with the first sub-band and performing a second set of microphone mixing operations to generate a second adaptive mixer output associated with the second sub-band. The second set of microphone mixing operations is different from the first set of microphone mixing operations.

In another implementation, an apparatus includes a first microphone array processing component, a second microphone array processing component, a first band analysis filter component, a second band analysis filter component, and a first adaptive mixing component associated with the first sub-band. The first microphone array processing component is configured to receive a plurality of microphone signals from a plurality of microphones and to generate a first microphone array processing signal. The first microphone array processing signal is associated with a frequency band that includes a plurality of sub-bands. The second microphone array processing component is configured to receive the plurality of microphone signals from the plurality of microphones and to generate a second microphone array processing signal. The second microphone array processing signal is associated with the frequency band that includes the plurality of sub-bands. The first band analysis filter is component configured to generate a first output based on the first microphone array processing signal. The first output corresponds to a first sub-band of the plurality of sub-bands. The second band analysis filter component is configured to generate a second output based on the second microphone array processing signal. The second output corresponds to the first sub-band. The first adaptive mixing component is configured generate a first adaptive mixer output associated with the first sub-band based on a comparison of the first output to the second output.

In yet another implementation, a system includes a plurality of microphones, a first microphone array processing component, a second microphone array processing component, a first band analysis filter component, a second band analysis filter component, a first adaptive mixing component, and a first synthesis component. The first microphone array processing component is configured to generate a first microphone array processing signal based on a plurality of microphone signals received from the plurality of microphones. The first microphone array processing signal is associated with a frequency band that includes a plurality of sub-bands. The second microphone array processing component configured to generate a second microphone array processing signal based on the plurality of microphone signals received from the plurality of microphones. The second microphone array processing signal is associated with the frequency band that includes the plurality of sub-bands. The first band analysis filter component is configured to generate a first output based on the first microphone array processing signal. The first output corresponds to a first sub-band of the plurality of sub-bands. The second band analysis filter component is configured to generate a second output based on the second microphone array processing signal. The second output corresponds to the first sub-band. The first adaptive mixing component is associated with the first sub-band, and the first adaptive mixing component is configured generate a first adaptive mixer output associated with the first sub-band based on a comparison of the first output to the second output. The first synthesis component is associated with the first adaptive mixing component, and the first synthesis component configured to generate a first synthesized sub-band output signal based on the first adaptive mixer output.

IV. BRIEF DESCRIPTION OF THE DRAWINGS

V. DETAILED DESCRIPTION

Figure 1:
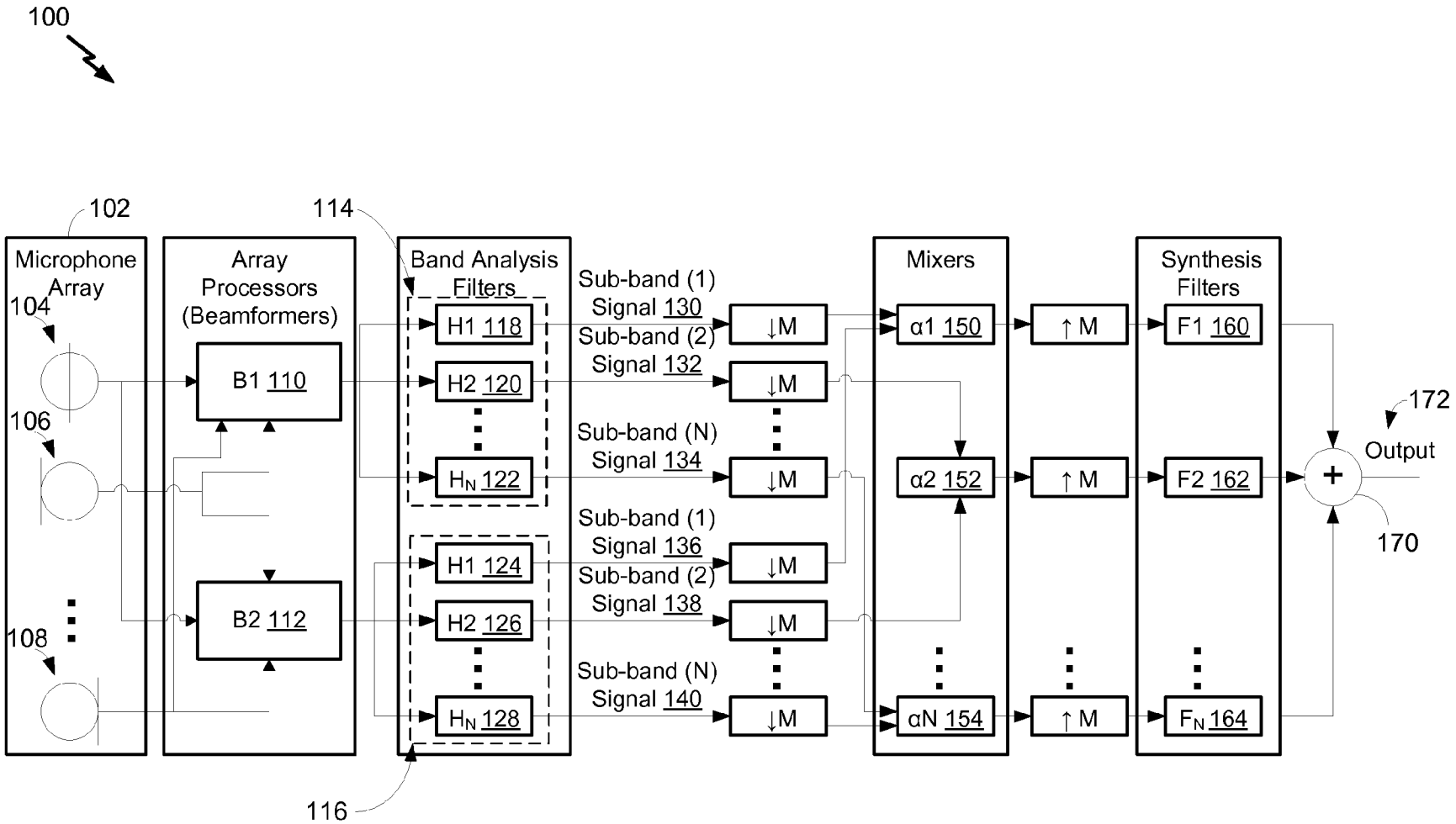
FIG. 1 is a diagram of an illustrative implementation of a system for adaptive mixing of sub-band signals.

In some cases, a headset (e.g., a wired or wireless headset) that is used for voice communication uses various noise mitigation strategies to reduce an amount of noise that is captured by microphone(s) of the headset. For example, noise may include ambient noise and/or wind noise. Mitigation of the noise may reduce an amount of noise that is heard by a far-end communication partner. As another example, mitigation of the noise may improve speech recognition for a remote speech recognition engine. In some instances, one noise mitigation strategy (e.g., a first "beamforming" strategy) represents a "more directional" strategy that is more effective at ambient noise mitigation but is less effective at wind noise mitigation. Another noise mitigation strategy (e.g., a second "beamforming" strategy) represents a "less directional" strategy that is more effective at wind noise mitigation but is less effective at ambient noise mitigation.

The present disclosure describes systems and methods of adaptive mixing of multiple analysis sections of a band (e.g., multiple sub-bands of a frequency domain signal representation, such as a frequency band). In the present disclosure, multiple microphone mixing algorithms are used to modify sub-band signals for multiple different sub-bands based on an energy in the individual sub-band signals in order to improve a signal-to-noise ratio (SNR) of speech over surrounding noise in the individual sub-bands. As an example, wind noise is band-limited (e.g., less than about 1 KHz in a frequency domain). In the case of wind noise, a "less directional" noise mitigation strategy is used for sub-band(s) associated with wind noise in some instances, instead of applying a "wide band gain" across an entire band (including a portion of the band that is not associated with wind noise). In the sub-bands that are not associated with wind noise (e.g., sub-bands above about 1 KHz), a "more directional" noise mitigation strategy is used (that may be more effective at ambient noise mitigation), in some instances.

In some cases, the sub-band adaptive mixing method of the present disclosure provides improved performance compared to active wind noise mitigation solutions that apply a wide-band gain over an entire band (e.g., for a noise-cancelling headset that is used for telecommunications, in order to reduce an amount of noise in a signal that is transmitted to a far-end party). For example, in some cases, the sub-band adaptive mixing method of the present disclosure results in a higher SNR in a larger portion of a band (e.g., a narrow band signal corresponding to an 8 KHz band or a wide band signal corresponding to a 16 KHz band) as well as a reduction in reverberation relative to mixing methods that operate over the entire band.

As an illustrative example of wind noise mitigation, a superdirectional microphone array (e.g., a velocity microphone) and an omnidirectional microphone (e.g., a pressure microphone) may be associated with a headset. In general, a superdirectional microphone array has less sensitivity to ambient noise than an omnidirectional microphone, and the superdirectional microphone array has more sensitivity to wind noise than the omnidirectional microphone. By separating a band into multiple sub-bands (e.g., 8 sub-bands), a "less directional" solution is applied to a first set of sub-bands (e.g., a first 3 sub-bands), while a "more directional" solution is applied to a second set of sub-bands (e.g., a next 5 sub-bands). Outputs of the different mixing operations are then combined to generate an output signal. In the presence of wind noise, selectively applying different mixing solutions to different sub-bands may result in a reduction in reverberation due to higher directivity in the output signal. Further benefits may include an increased SNR of the output signal (to be sent to a far-end party) and depth of voice due to the partial proximity effect that is coupling through sub-band mixing.

In practice, in the presence of wind noise, the adaptive sub-band mixing algorithm of the present disclosure may favor an output of the "less directional" solution (as applied to e.g., the first 3 sub-bands). In some cases, this results in a nearly "binary" decision and parsing the output of the "less directional" output signal exclusively with less than 10 percent of mixing with an output of the "more directional" solution (as applied to e.g., the next 5 sub-bands). This result may vary for different headsets due to tuning and passive wind noise protection. Applying the "less directional" solution to selected sub-bands that are associated with wind noise may reduce an amount of wind noise in an output signal while allowing the "more directional" solution to be applied to a remainder of the band for improved ambient noise mitigation.

Referring to FIG. 1, an example of a system for adaptive mixing of sub-band signals is illustrated and generally designated 100. FIG. 1 illustrates that outputs from multiple microphone array processing blocks (e.g., beamformers) may be partitioned into multiple sub-bands (or "analysis sections"). Signals associated with different sub-bands may be sent to different mixing components for processing. A first set of microphone mixing operations may be performed for a first sub-band in order to improve a signal-to-noise ratio of the first sub-band, and a second set of microphone mixing operations may be performed for a second sub-band in order to improve a signal-to-noise ratio of the second sub-band. In some cases, a "less directional" solution may improve a SNR for a first set of sub-band signals (e.g., in a band-limited frequency range, such as less than about 1 KHz for wind noise). In other cases, a "more directional" solution may be used to improve a signal-to-noise ratio for a second set of sub-band signals (e.g., outside of the band-limited frequency range associated with wind noise).

In the example of FIG. 1, the system 100 includes a plurality of microphones of a microphone array 102 that includes two or more microphones. For example, in the particular implementation illustrated in FIG. 1, the microphone array 102 includes a first microphone 104, a second microphone 106, and an Nth microphone 108. In alternative implementations, the microphone array 102 may include two microphones (e.g., the first microphone 104 and the second microphone 106). A gradient microphone may have a bidirectional microphone pattern, which may be useful in providing a good voice response in a wireless headset, where the microphone can be pointed in the general direction of a user's mouth. Such a microphone may provide a good response in ambient noise, but is susceptible to wind noise. A pressure microphone tends to have an omnidirectional microphone pattern.

The system 100 further includes two or more microphone array processing components (e.g., "beamformers"). In the particular implementation illustrated in FIG. 1, the system 100 includes a first microphone array processing component 110 (e.g., a first beamformer, identified as "B1" in FIG. 1, such as a "highly directional" beamformer or VMIC that is designed for use in a diffuse noise environment). The system 100 also includes a second microphone array processing component 112 (e.g., a second beamformer, identified as "B2" in FIG. 1, such as a "less directional" beamformer or PMIC that is designed for use in a wind noise environment). In alternative implementations, more than two microphone array processing components (e.g., more than two beamformers) may be used. Further, in some cases, other band-limited sensors may be communicatively coupled to a third beamformer (e.g., a "B3" that is not shown in FIG. 1) to provide an additional band-limited signal for improved noise mitigation. Other examples of band-limited sensors may include a bone conducting microphone, a feedback microphone in ANR, a piezoelectric element, an optical Doppler velocimeter monitoring remotely vibration of the skin, or a pressure element monitoring directly through contact vibration of the skin, among other alternatives. Voice through bone and skin conduction is band-limited to low frequencies.

FIG. 1 illustrates that the first microphone 104 is communicatively coupled to the first microphone array processing component 110 and to the second microphone array processing component 112. The first microphone array processing component 110 and the second microphone array processing component 112 are configured to receive a first microphone signal from the first microphone 104. FIG. 1 further illustrates that the second microphone 106 is communicatively coupled to the first microphone array processing component 110 and to the second microphone array processing component 112. The first microphone array processing component 110 and the second microphone array processing component 112 are configured to receive a second microphone signal from the second microphone 106. In the particular implementation illustrated in FIG. 1, the microphone array 102 includes more than two microphones. In this example, the Nth microphone 108 is communicatively coupled to the first microphone array processing component 110 and to the second microphone array processing component 112. The first microphone array processing component 110 and the second microphone array processing component 112 are configured to receive an Nth microphone signal from the Nth microphone 108. In alternative implementations, the system 100 includes more than two microphone array processing components (e.g., "beamformers") that receive microphone signals from the multiple microphones of the microphone array 102.

The first microphone array processing component 110 is configured to generate a first microphone array processing signal that is associated with a frequency band that includes a plurality of sub-bands. As an example, the frequency band may correspond to a narrow band, such as an 8 KHz band, among other alternatives. As another example, the frequency band may correspond to a wide band, such as a 16 KHz band, among other alternatives. In a particular implementation, the first microphone array processing component 110 includes a first beamforming component that is configured to perform a first set of beamforming operations based on the multiple microphone signals received from the microphones of the microphone array 102. In a particular instance, the first set of beamforming operations includes one or more directional microphone beamforming operations.

The second microphone array processing component 112 is configured to generate a second microphone array processing signal that is associated with the frequency band. In a particular implementation, the second microphone array processing component 112 includes a second beamforming component that is configured to perform a second set of beamforming operations based on the microphone signals received from the microphones of the microphone array 102. In a particular instance, the second set of beamforming operations includes one or more omnidirectional microphone beamforming operations.

The system 100 further includes a plurality of band analysis filters. In the example of FIG. 1, the band analysis filters include a first set of band analysis filters 114 associated with the first microphone array processing component 110 and a second set of band analysis filters 116 associated with the second microphone array processing component 112. The band analysis filters are configured to determine multiple analysis sections for a particular band. In some cases, the analysis sections may correspond to different frequency sub-bands of a particular frequency band (e.g., a "narrow" frequency band such as an 8 KHz band or a "wide" frequency band such as a 16 KHz band). As the band analysis filters operate as filter banks, other examples of analysis sections may be used depending on a particular type of filter bank. For example, a cosine-modulated filter bank may be made complex, referred to as "VFE" filter banks for a frequency domain. In some cases, the analysis sections may correspond to time domain samples. In other cases, the analysis sections may correspond to frequency domain samples. Further, while FIG. 1 illustrates one example of a filter bank, other implementations are contemplated. To illustrate, the filter bank may be implemented as a uniform filter bank or as a non-uniform filter bank. Sub-band filters may also be implemented as a cosine modulated filter bank (CMFB), a wavelet filter bank, a DFT filter bank, a filter bank based on BARK scale, or an octave filter bank, among other alternatives.

To illustrate, a cosine modulated filter bank (CFMB) may be used in MPEG standard for audio encoding. In this case, after an analysis portion of the filter bank, a signal includes only "real" components. This type of filter bank may be efficiently implemented using discrete cosine transforms (e.g., DCT and MDCT). Other examples of filter banks include DFT modulated filter banks, generalized DFT filter banks, or a complex exponential modulated filter bank. In this case, after an analysis portion of the filter bank, a signal includes complex-valued components corresponding to frequency bins. DFT filter banks may be efficiently implemented via weighted overlap add (WOLA) DFT filter banks, where fast Fourier transforms (FFTs) may be used for efficient calculation of DFT transform. A WOLA DFT filter bank may be numerically efficient for implementing on embedded hardware.

In the particular implementation illustrated in FIG. 1, the first set of band analysis filters 114 associated with the first microphone array processing component 110 includes a first band analysis filter 118 (identified as "H1" in FIG. 1), a second band analysis filter 120 (identified as "H2" in FIG. 1), and an Nth band analysis filter 122 (identified as "H1" in FIG. 1). The second set of band analysis filters 116 associated with the second microphone array processing component 112 includes a first band analysis filter 124 (identified as "H1" in FIG. 1), a second band analysis filter 126 (identified as "H2" in FIG. 1), and an Nth band analysis filter 128 (identified as "$H_N$" in FIG. 1). As an example, the first band analysis filter 118 (H1) may be a low pass filter (in the case of an even stacked filter bank) or a band pass filter (in the case of an odd stacked filter bank). As another example, the Nth band analysis filter ($H_N$) may be a high pass filter (in the case of even stacking) or a band analysis filter (in the case of odd stacking). Other filters (e.g., H2) may be band pass filters. Additionally, filter banks may be decimated (N=M) or oversampled (M<N). Some filter banks may be more robust to signal modification in sub-band processing and may be utilized in some audio and speech applications.

The first band analysis filter 118 of the first set of band analysis filters 114 is configured to generate a first output 130 based on the microphone array processing signal received from the first microphone array processing component 110. The first output 130 corresponds to a first sub-band of a plurality of sub-bands (identified as "Sub-band(1) signal" in FIG. 1). The second band analysis filter 120 of the first set of band analysis filters 114 is configured to generate a second output 132 based on the microphone array processing signal received from the first microphone array processing component 110. The second output 132 corresponds to a second sub-band of the plurality of sub-bands (identified as "Sub-band(2) signal" in FIG. 1). The Nth band analysis filter 122 of the first set of band analysis filters 114 is configured to generate an Nth output 134 based on the microphone array processing signal received from the first microphone array processing component 110. The Nth output 134 corresponds to an Nth sub-band of the plurality of sub-bands (identified as "Sub-band(N) signal" in FIG. 1).

The first band analysis filter 124 of the second set of band analysis filters 116 is configured to generate a first output 136 based on the microphone array processing signal received from the second microphone array processing component 112. The first output 136 corresponds to the first sub-band (identified as "Sub-band(1) signal" in FIG. 1). The second band analysis filter 126 of the second set of band analysis filters 116 is configured to generate a second output 138 based on the microphone array processing signal received from the second microphone array processing component 112. The second output 136 corresponds to the second sub-band (identified as "Sub-band(2) signal" in FIG. 1). The Nth band analysis filter 128 of the second set of band analysis filters 116 is configured to generate an Nth output 140 based on the microphone array processing signal received from the second microphone array processing component 112. The Nth output 140 corresponds to the Nth sub-band (identified as "Sub-band(N) signal" in FIG. 1). In the particular implementation illustrated in FIG. 1, the system 100 further includes a plurality of decimation components (identified by the letter "M" along with a downward arrow in FIG. 1) configured to perform one or more decimation operations on one or more outputs of the band analysis filters. In some cases, a value of M may be one (no decimation), while in other cases a value of M may less than one.

The system 100 further includes a plurality of (adaptive) mixing components. In the particular implementation illustrated in FIG. 1, the mixing components include a first mixing component 150 (identified as "α1" in FIG. 1), a second mixing component 152 (identified as "α2" in FIG. 1), and an Nth mixing component 154 (identified as "αN" in FIG. 1). The first mixing component 150 is configured to receive the first output 130 corresponding to the first sub-band from the first band analysis filter 118 of the first set of band analysis filters 114. The first mixing component 150 is further configured to receive the first output 136 corresponding to the first sub-band from the first band analysis filter 124 of the second set of band analysis filters 116. The first mixing component 150 is configured to generate a first adaptive mixer output associated with the first sub-band based on the outputs 130 and 136.

As described further herein, the first mixing component 150 uses a first scaling factor (also referred to as a "first mixing coefficient" or α1) to generate the first adaptive mixer output associated with the first sub-band. In some instances, the first mixing coefficient (α1) is selected or computed such that whichever of the first outputs 130 and 136 that has less noise provides a greater contribution to the first adaptive mixer output associated with the first sub-band. In some cases, the first mixing coefficient (α1) may vary between zero and one. Other values may also be used, including a narrower range (e.g., to use at least a portion of each of the outputs 130, 136) or a wider range (e.g., to allow one of the outputs 130, 136 to overdrive the first adaptive mixer output), among other alternatives.

In some implementations, a normalized least-mean-squares (NLMS) algorithm may be utilized for microphone mixing operations. An NLMS algorithm may be generalized for use in filter banks with real-valued outputs after analysis (e.g., CMFB filter banks or wavelet filter banks) or for use in filter banks with complex-valued outputs after analysis. The NLMS algorithm relies on a normalized-LMS type system to detect power in multiple signals and to reduce a weight on the signals accordingly. A weighted output may be determined according to Equation (1) below:

$$y(n)=\alpha(n)W(n)+(1-\alpha(n)D(n)) \tag{1}$$

In Equation (1) above, α(n) is the system identifying weight to be estimated, W(n) and D(n) are the beamformed or single element outputs. For example, referring to FIG. 1, W(n) and D(n) may correspond to the outputs of the first beamformer (B1) 110 and the second beamformer (B2) 112, respectively. As illustrative examples, the outputs may correspond to velocity and pressure microphone signals, MVDR outputs, delay-and-sum beam former outputs, or other sensor combinations that may receive voice signals with different performance over bands relative to each other in various noise environments. For example, the signals may be received from a bone conducting microphone, a feedback microphone in ANR, a piezoelectric element, an optical Doppler velocimeter monitoring vibration of the face, among other alternatives.

In Equation (1) above, Index n is a sample index from 1 to L. In the case of a frame processing scheme, L represents a frame size. In the case of a sample processing scheme, L represents the frame size for power normalization in a sample. A generalized assumption may be made that all of the samples are the outputs per filter bank (e.g., the band analysis filters of FIG. 1) and can be both real or complex (e.g., if y(n) is complex, so are W(n) and D(n). A cost function to be reduced (e.g., minimized) may be determined according to Equation (2) below:

$$J(n)=E\{|y(n)|^2\}=E\{y(n)y^H(n)\} \tag{2}$$

In Equation (2) above, H is a Hermitian operator in the case of vectors. In the case of single values, H is a * conjugate. To find the weight α(n) to reduce the cost function, a partial derivative of J(n) with respect to α(n) may be used, according to Equation (3) below:

$$\nabla_\alpha J(n)=\nabla_\alpha E\{y(n)y^H(n)\}=2E\{\nabla_\alpha(y(n))y^H(n)\} \tag{3}$$

In Equation (3) above, $\nabla_\alpha(y(n))=\nabla_\alpha(\alpha(n)W(n)+(1-\alpha(n)D(n)))=W(n)-D(n)$. Thus, $\nabla_\alpha J(n)=2E\{(W(n)-D(n))y^H(n)\}$.

As a mean-square error update equation, or stochastic gradient recursion, has the form $$\alpha(n)=\alpha(n+1)-\frac{\mu}{2}\nabla J(n),$$

the following may be calculated:

$$\begin{aligned}\alpha(n+1)&=\alpha(n)-\mu\nabla_\alpha J(n)\\&=\alpha(n)-\mu E\{(W(n)-D(n))y^H(n)\}\end{aligned}$$

An unbiased error estimator may be used for approximation of an expectation function, as shown below:

$$\hat{E}\{(W(n)-D(n))y^H(n)\}=1/L\sum_{i=0}^{L-1}(W(n-i)-D(n-i))y^H(n-i)$$

For the simple case of L=1, this reduces to:

$$\hat{E}\{(W(n)-D(n))y^H(n)\}=(W(n)-D(n))y^H(n)$$

The weight equation may be defined as follows:

$$\alpha(n+1)=\alpha(n)-\mu(W(n)-D(n))y^H(n)$$

In this case, μ is a step size or a learning rate. Practical implementation may include regularized Newton's recursion form where learning rate is controlled by normalizing or scaling of the input signal with signal power and regularization constant, as shown below:

$$(n+1)=\alpha(n)+\mu\frac{W(n)-D(n)}{\frac{1}{L}\sum_{i=o}^{L-1}((D(i)-W(i))(D(i)-W(i))^H)+\varepsilon(i)}y^H(n)$$

In this case, ϵ(i) is a small positive constant, ϵ(i)>0, added to ensure numerical stability (protect against division by zero), and L is greater than 0. With respect to FIG. 1, the last result may be represented as a function of filterbank decomposition, as shown in Equation (4) below:

$$\alpha_k(n+1)=\alpha_k(n)+\mu_k\frac{W_k(n)-D_k(n)}{\frac{1}{L}\sum_{i=0}^{L-1}((D_k(i)-W_k(i))(D_k(i)-W_k(i))^H)+\varepsilon_k}y^H(n) \quad (4)$$

In Equation (4) above, index k is introduced, where k=1: N and where N is a number of filter banks or microphone mixing bands. For each of the bands, a microphone mixing procedure may be used to blend the signals.

In the case of a filter bank with complex-valued samples (e.g., a WOLA DFT filter bank), Equation (4) may be utilized. In the case of a filter bank with real-valued samples (e.g., CFMB), Equation (4) may be reduced to a simpler form, as shown in Equation (5) below:

$$\alpha_k(n+1)=\alpha_k(n)+\mu_k\frac{W_k(n)-D_k(n)}{\frac{1}{L}\sum_{i=0}^{L-1}((D_k(i)-W_k(i))^2)+\varepsilon_k}y(n) \quad (5)$$

In general, for the same block scheme of data, a real-valued data approach is numerically more efficient than the complex-valued approach.

The second mixing component 152 is configured to receive the second output 132 corresponding to the second sub-band from the second band analysis filter 120 of the first set of band analysis filters 114. The second mixing component 152 is further configured to receive the second output 138 corresponding to the second sub-band from the second band analysis filter 126 of the second set of band analysis filters 116. The second mixing component 152 is configured to generate a second adaptive mixer output associated with the second sub-band based on the outputs 132 and 138.

As described further herein, the second mixing component 152 uses a second scaling factor (also referred to as a "second mixing coefficient" or α2) to generate the second adaptive mixer output associated with the second sub-band. The second mixing coefficient (α2) may be selected or computed such that whichever of the second outputs 132 and 138 that has less noise provides a greater contribution to the second adaptive mixer output associated with the second sub-band. In some cases, the second mixing coefficient (α2) may vary between zero and one. Other values may also be used, including a narrower range (e.g., to use at least a portion of each of the outputs 132, 138), a wider range (e.g., to allow one of the outputs 132, 138 to overdrive the second adaptive mixer output). In some cases, the second mixing coefficient (α2) may be a dynamic value. In other cases, the second mixing coefficient (α2) may be a constant value.

The Nth mixing component 154 is configured to receive the Nth output 134 corresponding to the Nth sub-band from the Nth band analysis filter 122 of the first set of band analysis filters 114. The Nth mixing component 154 is further configured to receive the Nth output 140 corresponding to the Nth sub-band from the Nth band analysis filter 128 of the second set of band analysis filters 116. The Nth mixing component 154 is configured to generate an Nth adaptive mixer output associated with the Nth sub-band based on the outputs 134 and 140.

As described further herein, the Nth mixing component 154 may use an Nth scaling factor (also referred to as an "Nth mixing coefficient" or αN) to generate the Nth adaptive mixer output associated with the Nth sub-band. The Nth mixing coefficient (αN) may be selected or computed such that whichever of the Nth outputs 134 and 140 that has less noise provides a greater contribution to the Nth adaptive mixer output associated with the Nth sub-band. In some cases, the Nth mixing coefficient (αN) may vary between zero and one. Other values may also be used, including a narrower range (e.g., to use at least a portion of each of the outputs 134, 140), a wider range (e.g., to allow one of the outputs 134, 140 to overdrive the Nth adaptive mixer output). In some cases, the Nth mixing coefficient (αN) may be a dynamic value. In other cases, the Nth mixing coefficient (αN) may be a constant value.

In the particular implementation illustrated in FIG. 1, the system 100 further includes a plurality of interpolation components (identified by the letter "M" with an upward arrow in FIG. 1) configured to perform one or more interpolation operations on one or more outputs of the adaptive mixer outputs. FIG. 1 further illustrates that the system 100 may include a plurality of synthesis components (or synthesis "filters"). For example, in the particular implementation illustrated in FIG. 1, the plurality of synthesis components includes a first synthesis component 160 (identified as "F1" in FIG. 1), a second synthesis component 162 (identified as "F2" in FIG. 2), and an Nth synthesis component 164 (identified as "$F_N$" in FIG. 1).

The first synthesis component 160 is associated with the first mixing component 150 and is configured to generate a first synthesized sub-band output signal based on the first adaptive mixer output received from the first mixing component 150. The second synthesis component 160 is associated with the second adaptive mixing component 152 and is configured to generate a second synthesized sub-band output signal based on the second adaptive mixer output received from the second mixing component 152. The Nth synthesis component 164 is associated with the Nth adaptive mixing component 154 and is configured to generate an Nth synthesized sub-band output signal based on the Nth adaptive mixer output received from the Nth mixing component 154.

The synthesis components 160-164 are configured to provide synthesized sub-band output signals to a combiner 170. The combiner 170 is configured to generate an audio output signal 172 based on a combination of synthesized sub-band output signals received from the synthesis components 160-164. In the particular implementation illustrated in FIG. 1, the combiner 170 is configured to generate the audio output signal 172 based on a combination of the first synthesized sub-band output signal received from the first synthesis component 160, the second synthesized sub-band output signal received from the second synthesis component 162, and the Nth synthesized sub-band output signal received from the Nth synthesis component 164.

In operation, the first microphone array processing component 110 (e.g., the first beamformer) receives multiple microphone signals from the microphones of the microphone array 102 (e.g., from the first microphone 104, from the second microphone 106, and from the Nth microphone 108). In some instances, individual microphones of the microphone array 102 are associated with a headset, and the individual microphones are positioned at various locations on the headset (or otherwise connected to the headset, such as a boom microphone). To illustrate, one or more microphones of the microphone array 102 may be positioned on one side of the headset (e.g., facing an ear cavity, within the ear cavity, or a combination thereof), while one or more microphones of the microphone array 102 may be positioned on another side of the headset (e.g., in one or more directions to capture voice inputs).

The first microphone array processing component 110 employs a first beamforming strategy when processing the multiple microphone signals from the microphone array 102. The second microphone array processing component 112 employs a second beamforming strategy when processing the multiple microphone signals from the microphone array 102. In some cases, the first beamforming strategy corresponds to a "more directional" beamforming strategy than the second beamforming strategy. For example, in some cases, the first beamforming strategy is better suited for one application (e.g., ambient-noise cancellation), while the second beamforming strategy is better suited for another application (e.g., wind-noise cancellation). As different beamforming strategies are employed, different beamformer outputs are generated by the different microphone array processing components 110, 112.

The outputs of the different microphone array processing components 110, 112 are provided to the band analysis filters. For example, an output of the first microphone array processing component 110 is provided to the first set of band analysis filters 114, and an output of the second microphone array processing component 112 is provided to the second set of band analysis filters 116. The first set of band analysis filters 114 includes N band analysis filters 118-122 to analyze different sections of the output of the first microphone array processing component 110 (resulting from the first beamforming operation). The second set of band analysis filters 116 includes N band analysis filters 124-128 to analyze different sections of the output of the second microphone array processing component 112 (resulting from the second beamforming operation). To illustrate, based on a result of the first beamforming operation, the first band analysis filter 118 generates the first sub-band signal 130, the second band analysis filter 120 generates the second sub-band signal 132, and the Nth band analysis filter 122 generates the Nth sub-band signal 134. Based on a result of the second beamforming operation, the first band analysis filter 124 generates the first sub-band signal 136, the second band analysis filter 126 generates the second sub-band signal 138, and the Nth band analysis filter 128 generates the Nth sub-band signal 140.

FIG. 1 illustrates that the first outputs 130, 136 (associated with the first sub-band) are communicated to the first adaptive mixing component 150. The second outputs 132, 138 (associated with the second sub-band) are communicated to the second adaptive mixing component 152. The outputs 134, 140 (associated with the Nth sub-band) are communicated to the Nth adaptive mixing component 154. In the example of FIG. 1, decimation operations are performed on the sub-band signals prior to the sub-band signals being processed by the adaptive mixing components 150-154. The first adaptive mixing component 150 generates a first adaptive mixer output associated with the first sub-band based on the outputs 130 and 136. The second adaptive mixing component 152 generates a second adaptive mixer output associated with the second sub-band based on the outputs 132 and 138. The Nth adaptive mixing component 154 generates an Nth adaptive mixer output associated with the Nth sub-band based on the outputs 134 and 140.

As explained further above, a particular mixing coefficient that is used to "blend" output signals for a particular sub-band are selected or computed such that an output with a higher SNR represents a greater portion (or all) of a particular adaptive mixer output. In some instances, the first sub-band corresponds to wind noise (e.g., less than about 1 KHz). In some cases, the first microphone array processing component 110 employs a directional noise mitigation strategy, and the second microphone array processing component 112 employs an omnidirectional noise mitigation strategy. In the presence of wind noise, the first sub-band signal 130 generated by the first band analysis filter 118 is more affected by wind noise than the first sub-band signal 136 generated by the first band analysis filter 124. In this case, the first adaptive mixing component 150 selects the first sub-band signal 136 (the "less directional" output) in order to provide a higher SNR for the first sub-band. As another example, the second sub-band is outside of the band associated with wind noise (e.g., greater than about 1 KHz). In the presence of wind noise, the second sub-band signals 132, 138 may be less affected by wind noise than the first sub-band signals 130, 136. In this case, the second adaptive mixing component 152 selects the second sub-band signal 138 generated by the second band analysis filter 120 (the "more directional" output) in order to provide a higher SNR for the second sub-band.

FIG. 1 further illustrates that the first adaptive mixing component 150 sends the first adaptive mixer output associated with the first sub-band to the first synthesis filter 160 (with intervening interpolation). The second adaptive mixing component 152 sends the second adaptive mixer output associated with the second sub-band to the second synthesis filter 162 (with intervening interpolation). The Nth adaptive mixing component 154 sends the Nth adaptive mixer output associated with the Nth sub-band to the Nth synthesis filter 164 (with intervening interpolation). The combiner 170 combines the adaptive mixing output signals from the synthesis components 160-164 to generate the output signal 172 (to be communicated to a far-end party or to a speech recognition engine).

Thus, FIG. 1 illustrates an example of a system of adaptive mixing of sub-band signals. FIG. 1 illustrates that, in some cases, a "less directional" solution may improve a signal-to-noise ratio for a first set of sub-band signals (e.g., in a band-limited frequency range, such as less than about 1 KHz for wind noise). In other cases, a "more directional" solution may be used to improve a signal-to-noise ratio for a second set of sub-band signals (e.g., outside of the band-limited frequency range associated with wind noise).

Figure 2:
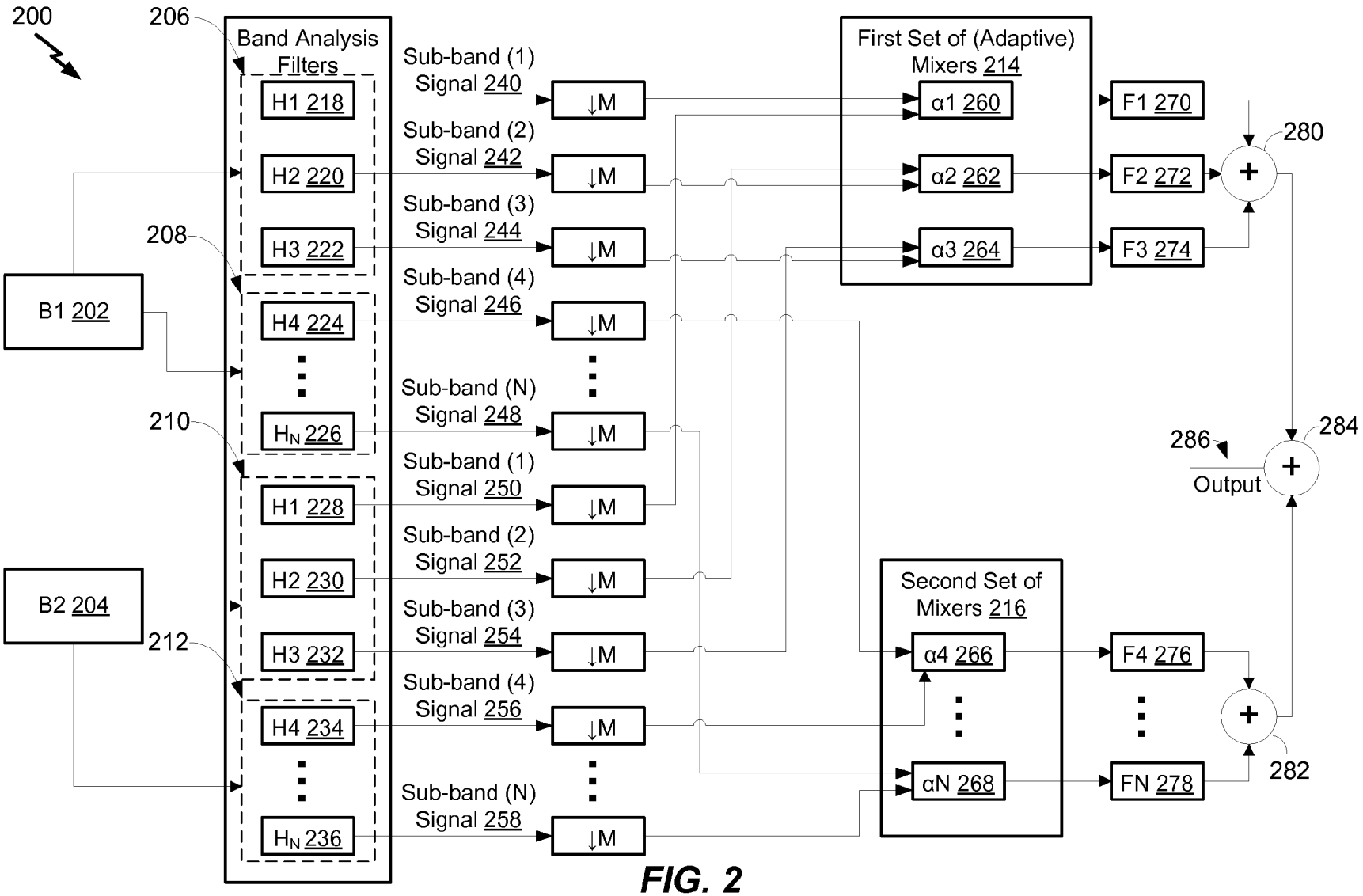
FIG. 2 is a diagram of an illustrative implementation of a system for adaptive mixing of a subset of sub-band signals.

Referring to FIG. 2, an example of a system of adaptive mixing of sub-band signals is illustrated and is generally depicted as 200. In the example of FIG. 2, select components (e.g., a microphone array, interpolation components, etc.) have been omitted for illustrative purposes only. FIG. 2 illustrates an example implementation in which a plurality of band analysis filters may generate a plurality of sub-band signals (e.g., N sub-band signals, such as 8 sub-band signals). A first subset of the sub-band signals (e.g., 3 of the 8 sub-band signals) may be provided to a set of adaptive mixing components (e.g., mixing components with adaptive a values). A second subset of sub-band signals (e.g., 5 of the 8 sub-band signals) may be provided to another set of mixing components (e.g., mixing components with static $\alpha$ values). To illustrate, the first subset of sub-band signals may be in a band-limited frequency range (e.g., less than about 1 KHz, where ambient noise may overlap with wind noise), and the second subset of sub-band signals may be outside of the band-limited frequency range.

In the example illustrated in FIG. 2, the system 200 includes a first microphone array processing component 202 (e.g., a first beamformer, identified as "B1" in FIG. 2) and a second microphone array processing component 204 (e.g., a second beamformer, identified as "B2" in FIG. 2). In some cases, the first microphone array processing component 202 of FIG. 2 may correspond to the first microphone array processing component 110 of FIG. 1. The second microphone array processing component 204 may correspond to the second microphone array processing component 112 of FIG. 1. While not shown in FIG. 2, the first microphone array processing component 202 and the second microphone array processing component 204 may be configured to receive microphone signals from a plurality of microphones of a microphone array (e.g., the microphones 104-108 of the microphone array 102 of FIG. 1).

In the example of FIG. 2, multiple band analysis filters are associated with the first microphone array processing component 202, and multiple band analysis filters are associated with the second microphone array processing component 204. The band analysis filters associated with the first microphone array processing component 202 include a first subset 206 of band analysis filters and a second subset 208 of band analysis filters. The band analysis filters associated with the second microphone array processing component 204 include a first subset 210 of band analysis filters and a second subset 212 of band analysis filters.

FIG. 2 illustrates that the first subset 206 of band analysis filters associated with the first microphone array processing component 202 are communicatively coupled to a first set of (adaptive) mixing components 214. The second subset 208 of band analysis filters associated with the first microphone array processing component 202 are communicatively coupled to a second set of mixing components 216. FIG. 2 further illustrates that the first subset 210 of band analysis filters associated with the second microphone array processing component 204 is communicatively coupled to the first set of (adaptive) mixing components 214. The second subset 212 of band analysis filters associated with the second microphone array processing component 204 are communicatively coupled to the second set of mixing components 216.

In FIG. 2, N band analysis filters are associated with the first microphone array processing component 202, and N band analysis filters are associated with the second microphone array processing component 204. In the illustrative, non-limiting example of FIG. 2, N is greater than four (e.g., 8 sub-bands). To illustrate, the first subset 206 of band analysis filters associated with the first microphone array processing component 202 includes three band analysis filters, and the first subset 210 of band analysis filters associated with the second microphone array processing component 204 includes three band analysis filters. The second subset 208 of band analysis filters associated with the first microphone array processing component 202 includes at least two band analysis filters, and the second subset 212 of band analysis filters associated with the second microphone array processing component 204 includes at least two band analysis filters. It will be appreciated that the number of band analysis filters in a particular subset may vary. For example, the first subsets 206, 210 may include less than three band analysis filters or more than three band analysis filters, and the second subsets 208, 212 may include a single band analysis filter or more than two band analysis filters.

In the example illustrated in FIG. 2, the first subset 206 of band analysis filters associated with the first microphone array processing component 202 includes a first band analysis filter 218 (identified as "H1" in FIG. 2), a second band analysis filter 220 (identified as "H2" in FIG. 2), and a third band analysis filter 222 (identified as "H3" in FIG. 2). The second subset 208 of band analysis filters associated with the first microphone array processing component 202 includes a fourth band analysis filter 224 (identified as "H4" in FIG. 2) and an Nth band analysis filter 226 (identified as "$H_N$" in FIG. 2).

The first subset 210 of band analysis filters associated with the second microphone array processing component 204 includes a first band analysis filter 228 (identified as "H1" in FIG. 2), a second band analysis filter 230 (identified as "H2" in FIG. 2), and a third band analysis filter 232 (identified as "H3" in FIG. 2). The second subset 212 of band analysis filters associated with the second microphone array processing component 204 includes a fourth band analysis filter 234 (identified as "H4" in FIG. 2) and an Nth band analysis filter 236 (identified as "$H_N$" in FIG. 2).

Referring to the first subset 206 of band analysis filters, the first band analysis filter 218 is configured to generate a first output 240 that corresponds to a first sub-band (identified as "Sub-band(1) signal" in FIG. 2). The second band analysis filter 220 is configured to generate a second output 242 that corresponds to a second sub-band (identified as "Sub-band(2) signal" in FIG. 2). The third band analysis filter 222 is configured to generate a third output 244 that corresponds to a third sub-band (identified as "Sub-band(3) signal" in FIG. 2). Referring to the second subset 208 of band analysis filters, the fourth band analysis filter 224 is configured to generate a fourth output 246 that corresponds to a fourth sub-band (identified as "Sub-band(4) signal" in FIG. 2). The Nth band analysis filter 226 is configured to generate an Nth output 248 that corresponds to an Nth sub-band (identified as "Sub-band(N) signal" in FIG. 2).

Referring to the first subset 210 of band analysis filters, the first band analysis filter 228 is configured to generate a first output 250 that corresponds to the first sub-band (identified as "Sub-band(1) signal" in FIG. 2). The second band analysis filter 230 is configured to generate a second output 252 that corresponds to the second sub-band (identified as "Sub-band(2) signal" in FIG. 2). The third band analysis filter 232 is configured to generate a third output 254 that corresponds to the third sub-band (identified as "Sub-band (3) signal" in FIG. 2). Referring to the second subset 212 of band analysis filters, the fourth band analysis filter 234 is configured to generate a fourth output 256 that corresponds to the fourth sub-band (identified as "Sub-band(4) signal" in FIG. 2). The Nth band analysis filter 236 is configured to generate an Nth output 258 that corresponds to the Nth sub-band (identified as "Sub-band(N) signal" in FIG. 2).

In the example of FIG. 2 (where the first subsets 206 and 210 include three band analysis filters to generate three sub-band signals), the first set of (adaptive) mixing components 214 includes a first mixing component 260 (identified as "α1" in FIG. 2), a second mixing component 262 (identified as "α2" in FIG. 2), and a third mixing component 264 (identified as "α3" in FIG. 2). The second set of mixing components 216 includes a fourth mixing component 266 (identified as "α4" in FIG. 2) and an Nth mixing component 268 (identified as "αN" in FIG. 2).

The first mixing component 260 is configured to receive the first output 240 corresponding to the first sub-band from the first band analysis filter 218 (associated with the first microphone array processing component 202). The first mixing component 260 is further configured to receive the first output 250 corresponding to the first sub-band from the first band analysis filter 228 (associated with the second microphone array processing component 204). The first mixing component 260 is configured to generate a first adaptive mixer output associated with the first sub-band based on the outputs 240 and 250.

The first mixing component 260 may use a first scaling factor (also referred to as a "first mixing coefficient" or α1) to generate a first adaptive mixer output associated with the first sub-band. The first mixing coefficient (α1) may be selected or computed such that whichever of the first outputs 240 and 250 that has less noise provides a greater contribution to the first adaptive mixer output associated with the first sub-band. In some cases, the first mixing coefficient (α1) may vary between zero and one. Other values may also be used, including a narrower range (e.g., to use at least a portion of each of the outputs 240, 250) or a wider range (e.g., to allow one of the outputs 240, 250 to overdrive the first adaptive mixer output), among other alternatives.

The second mixing component 262 is configured to receive the second output 242 corresponding to the second sub-band from the second band analysis filter 220 (associated with the first microphone array processing component 202). The second mixing component 262 is further configured to receive the second output 252 corresponding to the second sub-band from the second band analysis filter 230 (associated with the second microphone array processing component 204). The second mixing component 262 is configured to generate a second adaptive mixer output associated with the second sub-band based on the outputs 242 and 252.

The second mixing component 262 may use a second scaling factor (also referred to as a "second mixing coefficient" or α2) to generate the second adaptive mixer output associated with the second sub-band. The second mixing coefficient (α2) may be selected or computed such that whichever of the first outputs 242 and 252 that has less noise provides a greater contribution to the second adaptive mixer output associated with the second sub-band. In some cases, the second mixing coefficient (α2) may vary between zero and one. Other values may also be used, including a narrower range (e.g., to use at least a portion of each of the outputs 242, 252) or a wider range (e.g., to allow one of the outputs 242, 252 to overdrive the second adaptive mixer output), among other alternatives.

The third mixing component 264 is configured to receive the third output 244 corresponding to the third sub-band from the third band analysis filter 222 (associated with the first microphone array processing component 202). The third mixing component 264 is further configured to receive the third output 254 corresponding to the third sub-band from the third band analysis filter 232 (associated with the second microphone array processing component 204). The third mixing component 264 is configured to generate a third adaptive mixer output associated with the third sub-band based on the outputs 244 and 254.

The third mixing component 264 may use a third scaling factor (also referred to as a "third mixing coefficient" or α3) to generate the third adaptive mixer output associated with the third sub-band. The third mixing coefficient (α3) may be selected or computed such that whichever of the third outputs 244 and 254 that has less noise provides a greater contribution to the third adaptive mixer output associated with the third sub-band. In some cases, the third mixing coefficient (α3) may vary between zero and one. Other values may also be used, including a narrower range (e.g., to use at least a portion of each of the outputs 244, 254) or a wider range (e.g., to allow one of the outputs 244, 254 to overdrive the third adaptive mixer output), among other alternatives.

The fourth mixing component 266 is configured to receive the fourth output 246 corresponding to the fourth sub-band from the fourth band analysis filter 224 (associated with the first microphone array processing component 202). The fourth mixing component 266 is further configured to receive the fourth output 256 corresponding to the fourth sub-band from the fourth band analysis filter 234 (associated with the second microphone array processing component 204). The fourth mixing component 266 is configured to generate a fourth mixer output associated with the fourth sub-band based on the outputs 246 and 256. In some cases, the fourth mixing component 266 may use a fourth scaling factor (α4) to generate the fourth mixer output associated with the fourth sub-band. For example, the fourth scaling factor (α4) may represent a "non-adaptive" static scaling factor to select either the fourth output 246 associated with the first microphone array processing component 202 or the fourth output 256 associated with the second microphone array processing component 204. As an example, when the fourth output 246 has less noise than the fourth output 256, the fourth mixing component 266 may "select" the fourth output 246 by applying a scaling factor of one to the fourth output 246 (and a scaling factor of zero to the fourth output 256). As another example, when the fourth output 246 has more noise than the fourth output 256, the fourth mixing component 266 may "select" the fourth output 256 by applying a scaling factor of zero to the fourth output 246 (and a scaling factor of one to the fourth output 256).

The Nth mixing component 268 is configured to receive the Nth output 248 corresponding to the Nth sub-band from the Nth band analysis filter 226 (associated with the first microphone array processing component 202). The Nth mixing component 268 is further configured to receive the Nth output 258 corresponding to the Nth sub-band from the Nth band analysis filter 236 (associated with the second microphone array processing component 204). The Nth mixing component 268 is configured to generate an Nth mixer output associated with the Nth sub-band based on the outputs 248 and 258. In some cases, the Nth mixing component 268 may use a "non-adaptive" scaling factor (αN) to select either the Nth output 248 associated with the first microphone array processing component 202 or the Nth output 258 associated with the second microphone array processing component 204. As an example, when the Nth output 248 has less noise than the Nth output 258, the Nth mixing component 268 may "select" the Nth output 248 by applying a scaling factor of one to the Nth output 248 (and a scaling factor of zero to the Nth output 258). As another example, when the Nth output 248 has more noise than the Nth output 258, the Nth mixing component 268 may "select" the Nth output 258 by applying a scaling factor of zero to the Nth output 248 (and a scaling factor of one to the Nth output 258).

In some cases, a plurality of interpolation components (not shown in FIG. 2) may be configured to perform one or more interpolation operations on one or more outputs of the adaptive mixer outputs. FIG. 2 further illustrates that the system 200 may include a plurality of synthesis components (or synthesis "filters"). For example, in the example illustrated in FIG. 2, the plurality of synthesis components includes a first synthesis component 270 (identified as "F1" in FIG. 2), a second synthesis component 272 (identified as "F2" in FIG. 2), and a third synthesis component 274 (identified as "F3" in FIG. 2). The first synthesis component 270, the second synthesis component 272, and the third synthesis component 274 are associated with the first set 214 of (adaptive) mixing components. FIG. 2 further illustrates a fourth synthesis component 276 (identified as "F4" in FIG. 2) and an Nth synthesis component 278 (identified as "$F_N$" in FIG. 2). The fourth synthesis component 276 and the Nth synthesis component 278 are associated with the second set 216 of mixing components.

The first synthesis component 270 is associated with the first mixing component 260 and is configured to generate a first synthesized sub-band output signal based on the first adaptive mixer output received from the first mixing component 260. The second synthesis component 272 is associated with the second adaptive mixing component 262 and is configured to generate a second synthesized sub-band output signal based on the second adaptive mixer output received from the second mixing component 262. The third synthesis component 274 is associated with the third adaptive mixing component 264 and is configured to generate a third synthesized sub-band output signal based on the third adaptive mixer output received from the third mixing component 264. The synthesis components 270-274 associated with the first set 214 of (adaptive) mixing components are configured to provide synthesized sub-band output signals to a combiner 280. The combiner 280 is configured to combine the synthesized sub-band output signals received from the synthesis components 270-274 (to be provided to a second combiner 284).

The fourth synthesis component 276 is associated with the fourth mixing component 266 and is configured to generate a fourth synthesized sub-band output signal based on the fourth mixer output received from the fourth mixing component 266. The Nth synthesis component 278 is associated with the Nth adaptive mixing component 268 and is configured to generate an Nth synthesized sub-band output signal based on the Nth mixer output received from the Nth mixing component 268. The synthesis components 276, 278 associated with the second set 216 of mixing components are configured to provide synthesized sub-band output signals to a combiner 282. The combiner 282 is configured to combine the synthesized sub-band output signals received from the synthesis components 276, 278 (to be provided to the second combiner 284). In the example of FIG. 2, the second combiner 284 is configured to generate an audio output signal 286 based on a combination of the synthesized sub-band output signals received from the synthesis components 270-278.

In operation, the first microphone array processing component 202 (e.g., the first beamformer) may receive multiple microphone signals (from microphones of a microphone array, not shown in FIG. 2). The first microphone array processing component 202 employs a first beamforming strategy when processing the multiple microphone signals. The second microphone array processing component 204 employs a second beamforming strategy when processing the multiple microphone signals. In some cases, the first beamforming strategy corresponds to a "more directional" beamforming strategy than the second beamforming strategy. For example, in some cases, the first beamforming strategy is better suited for one application (e.g., ambient-noise cancellation), while the second beamforming strategy is better suited for another application (e.g., wind-noise cancellation). As different beamforming strategies are employed, different beamformer outputs are generated by the different microphone array processing components 202, 204.

The outputs of the different microphone array processing components 202, 204 are provided to the band analysis filters. For example, the outputs of the first microphone array processing component 202 are provided to the first set 206 of band analysis filters and to the second set 208 of band analysis filters. The first set 206 of band analysis filters includes three band analysis filters 218-222 to analyze different sections of an output of the first microphone array processing component 202 (resulting from the first beamforming operation). The second set 208 of band analysis filters includes at least two band analysis filters 224, 226 to analyze different sections of the output of the first microphone array processing component 202 (resulting from the first beamforming operation). To illustrate, based on a result of the first beamforming operation, the first band analysis filter 218 generates the first sub-band signal 240, the second band analysis filter 220 generates the second sub-band signal 242, and the third band analysis filter 222 generates the third sub-band signal 244. Based on a result of the first beamforming operation, the fourth band analysis filter 224 generates the fourth sub-band signal 246, and the Nth band analysis filter 226 generates the Nth sub-band signal 248.

The outputs of the second microphone array processing component 204 are provided to the first set 210 of band analysis filters and to the second set 212 of band analysis filters. The first set 210 of band analysis filters includes three band analysis filters 228-232 to analyze different sections of an output of the second microphone array processing component 204 (resulting from the second beamforming operation). The second set 212 of band analysis filters includes at least two band analysis filters 234, 236 to analyze different sections of the output of the second microphone array processing component 204 (resulting from the second beamforming operation). To illustrate, based on a result of the second beamforming operation, the first band analysis filter 228 generates the first sub-band signal 250, the second band analysis filter 230 generates the second sub-band signal 252, and the third band analysis filter 232 generates the third sub-band signal 254. Based on a result of the second beamforming operation, the fourth band analysis filter 234 generates the fourth sub-band signal 256, and the Nth band analysis filter 236 generates the Nth sub-band signal 258.

FIG. 2 illustrates that the first sub-band signals 240, 250 are communicated to the first (adaptive) mixing component 260. The second sub-band signals 242, 252 are communicated to the second (adaptive) mixing component 262. The third sub-band signals 244, 254 are communicated to the third (adaptive) mixing component 264. In the example of FIG. 2, decimation operations are performed on the sub-band signals prior to the sub-band signals being processed by the adaptive mixing components 260-264. The first adaptive mixing component 260 generates a first adaptive mixer output associated with the first sub-band based on the outputs 240 and 250. The second adaptive mixing component 262 generates a second adaptive mixer output associated with the second sub-band based on the outputs 242 and 252. The third adaptive mixing component 264 generates a third adaptive mixer output associated with the third sub-band based on the outputs 244 and 254.

As explained further above, a particular mixing coefficient that is used to "blend" output signals for a particular sub-band are selected or computed such that an output with a higher SNR represents a greater portion (or all) of a particular adaptive mixer output. In some instances, the first three sub-bands may correspond to sub-bands where ambient noise and wind noise overlap. In some cases, the first microphone array processing component 202 employs a directional noise mitigation strategy, and the second microphone array processing component 204 employs an omnidirectional noise mitigation strategy.

The fourth sub-band signals 246, 256 are communicated to the fourth mixing component 266. The Nth sub-band signals 248, 258 are communicated to the Nth mixing component 268. In the example of FIG. 2, decimation operations are performed on the sub-band signals prior to the sub-band signals being processed by the mixing components 266, 268. The fourth mixing component 266 generates a fourth mixer output associated with the fourth sub-band based on the outputs 246 and 256. The Nth mixing component 268 generates an Nth mixer output associated with the Nth sub-band based on the outputs 248 and 258.

FIG. 2 further illustrates that the first adaptive mixing component 260 sends the first adaptive mixer output associated with the first sub-band to the first synthesis filter 270 (with intervening interpolation omitted in FIG. 2). The second adaptive mixing component 262 sends the second adaptive mixer output associated with the second sub-band to the second synthesis filter 272 (with intervening interpolation omitted in FIG. 2). The third adaptive mixing component 264 sends the third adaptive mixer output associated with the third sub-band to the third synthesis filter 274 (with intervening interpolation omitted in FIG. 2). The combiner 280 combines the adaptive mixing output signals from the adaptive mixing components 260-264. The fourth mixing component 266 sends the fourth mixer output associated with the fourth sub-band to the fourth synthesis filter 276 (with intervening interpolation omitted in FIG. 2). The Nth mixing component 268 sends the Nth mixer output associated with the Nth sub-band to the Nth synthesis filter 278 (with intervening interpolation omitted in FIG. 2). The combiner 282 combines the mixing output signals from the mixing components 266, 268. The second combiner 284 generates the output signal 286 (to be communicated to a far-end party or to a speech recognition engine) based on an output of the combiners 280, 282.

Thus, FIG. 2 illustrates an example implementation in which a plurality of band analysis filters generates a plurality of sub-band signals (e.g., N sub-band signals, such as 8 sub-band signals). A first subset of the sub-band signals (e.g., 3 of the 8 sub-band signals) may be provided to a set of adaptive mixing components (e.g., mixing components with adaptive $\alpha$ values). A second subset of sub-band signals (e.g., 5 of the 8 sub-band signals) may be provided to another set of mixing components (e.g., mixing components with "non-adaptive" static $\alpha$ values). To illustrate, the first subset of sub-band signals may be in a band-limited frequency range (e.g., less than about 1 KHz, where ambient noise may overlap with wind noise), and the second subset of sub-band signals may be outside of the band-limited frequency range.

Figure 3:
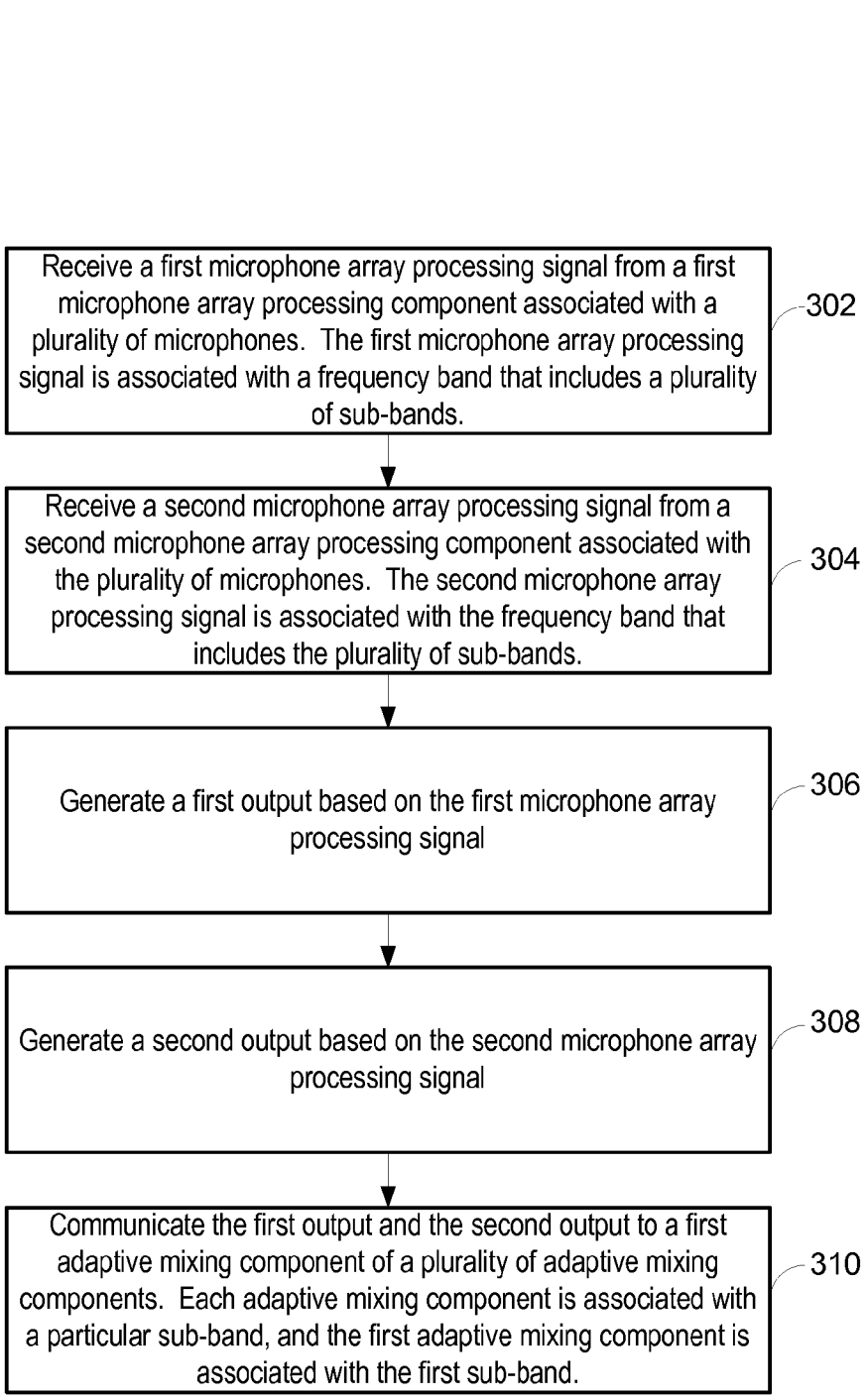
FIG. 3 is a flow chart of an illustrative implementation of a method of adaptive mixing of sub-band signals.

FIG. 3 is a flowchart of an illustrative implementation of a method 300 of adaptive mixing of sub-band signals. FIG. 3 illustrates that microphone array processing signals from different microphone array processing components (e.g., different beamformers that employ different beamforming strategies) may be partitioned into multiple analysis sections (e.g., sub-bands). The different microphone array processing signals for a particular sub-band are used to generate outputs that are communicated to an adaptive mixing component that is associated with the particular sub-band. Rather than applying a "wide band gain" over an entire band, separating a band into multiple analysis sections for processing may allow for adaptive mixing in the different analysis sections. Adaptive mixing in the different analysis sections allows for mitigation of wind noise in sub-band(s) associated with wind noise (e.g., less than about 1 KHz) and mitigation of ambient noise in remaining sub-band(s).

The method 300 includes receiving a first microphone array processing signal from a first microphone array processing component associated with a plurality of microphones, at 302. The first microphone array processing signal is associated with a frequency band that includes a plurality of sub-bands. As an example, referring to FIG. 1, the first band analysis filter 118 of the first set of band analysis filters 114 receives a microphone array processing signal from the first microphone array processing component 110 (e.g., a first beamformer). The first microphone array processing component 110 is associated with the microphones 104-108 of the microphone array 102.

The method 300 includes receiving a second microphone array processing signal from a second microphone array processing component associated with the plurality of microphones, at 304. The second microphone array processing signal is associated with the frequency band that includes the plurality of sub-bands. As an example, referring to FIG. 1, the first band analysis filter 124 of the first set of band analysis filters 116 receives a microphone array processing signal from the second microphone array processing component 112 (e.g., a second beamformer). The second microphone array processing component 112 is associated with the microphones 104-108 of the microphone array 102.

The method 300 includes generating a first output corresponding to a first sub-band of the plurality of sub-bands based on the first microphone array processing signal, at 306. As an example, referring to FIG. 1, the first band analysis filter 118 of the first set of band analysis filters 114 generates the first output 130 associated with the first sub-band based on the microphone array processing signal received from the first band analysis filter 118.

The method 300 includes generating a second output corresponding to the first sub-band based on the second microphone array processing signal, at 308. As an example, referring to FIG. 1, the first band analysis filter 124 of the second set of band analysis filters 116 generates the first output 136 associated with the first sub-band based on the microphone array processing signal received from the first band analysis filter 124.

The method 300 further includes communicating the first output and the second output to a first adaptive mixing component of a plurality of adaptive mixing components, at 310. Each adaptive mixing component is associated with a particular sub-band of the plurality of sub-bands, and the first adaptive mixing component is associated with the first sub-band. As an example, referring to FIG. 1, the first output 130 associated with the first sub-band is communicated from the first band analysis filter 118 (with optional intervening decimation) to the first adaptive mixing component 150 (that is associated with the first sub-band). Further, the first output 136 associated with the first sub-band is communicated from the first band analysis filter 124 (with optional intervening decimation) to the first adaptive mixing component 150 (that is associated with the first sub-band).

In some examples, implementations of the apparatus and techniques described above include computer components and computer-implemented steps that will be apparent to those skilled in the art. It should be understood by one of skill in the art that the computer-implemented steps can be stored as computer-executable instructions on a computer-readable medium such as, for example, floppy disks, hard disks, optical disks, flash memory, nonvolatile memory, and RAM. In some examples, the computer-readable medium is a computer memory device that is not a signal. Furthermore, it should be understood by one of skill in the art that the computer-executable instructions can be executed on a variety of processors such as, for example, microprocessors, digital signal processors, gate arrays, etc. For ease of description, not every step or element of the systems and methods described above is described herein as part of a computer system, but those skilled in the art will recognize that each step or element can have a corresponding computer system or software component. Such computer system and/or software components are therefore enabled by describing their corresponding steps or elements (that is, their functionality) and are within the scope of the disclosure.

Those skilled in the art can make numerous uses and modifications of and departures from the apparatus and techniques disclosed herein without departing from the inventive concepts. For example, components or features illustrated or describe in the present disclosure are not limited to the illustrated or described locations. As another example, examples of apparatuses in accordance with the present disclosure can include all, fewer, or different components than those described with reference to one or more of the preceding figures. The disclosed examples should be construed as embracing each and every novel feature and novel combination of features present in or possessed by the apparatus and techniques disclosed herein and limited only by the scope of the appended claims, and equivalents thereof.

What is claimed is:

1. A method comprising:

receiving a first microphone array processing signal, wherein the first microphone array processing signal is associated with a frequency band that includes a plurality of sub-bands;

receiving a second microphone array processing signal, wherein the second microphone array processing signal is associated with the frequency band that includes the plurality of sub-bands;

generating a first output based on the first microphone array processing signal, wherein the first output corresponds to a first sub-band of the plurality of sub-bands;

generating a second output based on the second microphone array processing signal, wherein the second output corresponds to the first sub-band of the plurality of sub-bands;

generating a third output based on the first microphone array processing signal, wherein the third output corresponds to a second sub-band of the plurality of sub-bands;

generating a fourth output based on the second microphone array processing signal, wherein the fourth output corresponds to the second sub-band;

performing a first set of microphone mixing operations to generate a first adaptive mixer output associated with the first sub-band, performing a second set of microphone mixing operations to generate a second adaptive mixer output associated with the second sub-band, wherein the second set of microphone mixing operations is different from the first set of microphone mixing operations;

communicating the first output and the second output to a first adaptive mixing component of a plurality of adaptive mixing components, wherein each adaptive mixing component is associated with a particular sub-band of the plurality of sub-bands, and wherein the first adaptive mixing component is associated with the first sub-band; and communicating the third output and the fourth output to a second adaptive mixing component of the plurality of adaptive mixing components, wherein the second adaptive mixing component is associated with the second sub-band, wherein the first adaptive mixing component performs the first set of microphone mixing operations to generate the first adaptive mixer output associated with the first sub-band, and the second adaptive mixing component performs the second set of microphone mixing operations to generate the second adaptive mixer output associated with the second sub-band, and wherein the second set of microphone mixing operations is selected to generate the second adaptive mixer output associated with the second sub-band responsive to the third output having a third signal-to-noise ratio that is lower than a fourth signal-to-noise ratio associated with the fourth output.

2. The method of claim 1, wherein the first sub-band corresponds to a first range of frequency values associated with wind noise.

3. The method of claim 2, wherein the second sub-band corresponds to a second range of frequency values associated with wind noise.

4. The method of claim 1, wherein the first microphone array processing signal is a result of a first set of beamforming operations performed on a plurality of microphone signals received from a plurality of microphones.

5. The method of claim 4, wherein the second microphone array processing signal is a second result of a second set of beamforming operations performed on the plurality of microphone signals received from the plurality of microphones.

6. The method of claim 5, wherein the first set of beamforming operations includes one or more omnidirectional microphone beamforming operations, and wherein the second set of beamforming operations includes one or more directional microphone beamforming operations.

7. The method of claim 1, further comprising:

performing one or more decimation operations on the first output; and performing one or more decimation operations on the second output.

8. The method of claim 1, further comprising:

comparing the first output to the second output;

in response to the first output having a higher signal-to-noise ratio than the second output, performing the first set of microphone mixing operations to generate the first adaptive mixer output associated with the first sub-band; and in response to the first output having a lower signal-to-noise ratio than the second output, performing the second set of microphone mixing operations.

9. An apparatus comprising:

a first microphone array processing component configured to:

receive a plurality of microphone signals from a plurality of microphones;

generate a first microphone array processing signal, wherein the first microphone array processing signal is associated with a frequency band that includes a plurality of sub-bands;

a second microphone array processing component configured to:

receive the plurality of microphone signals from the plurality of microphones;

generate a second microphone array processing signal, wherein the second microphone array processing signal is associated with the frequency band that includes the plurality of sub-bands;

a first band analysis filter component configured to generate a first output based on the first microphone array processing signal, wherein the first output corresponds to a first sub-band of the plurality of sub-bands;

a second band analysis filter component configured to generate a second output based on the second microphone array processing signal, wherein the second output corresponds to the first sub-band; and a first adaptive mixing component associated with the first sub-band, wherein the first adaptive mixing component is configured to:

generate a first adaptive mixer output associated with the first sub-band based on a comparison of the first output to the second output;

perform a first set of microphone mixing operations to generate the first adaptive mixer output when the first output has a higher signal-to-noise ratio than the second output, wherein the first set of microphone mixing operations is associated with wind noise mitigation; and perform a second set of microphone mixing operations to generate the first adaptive mixer output when the first output has a lower signal-to-noise ratio than the second output, wherein the second set of microphone mixing operations is associated with ambient noise mitigation.

10. The apparatus of claim 9, wherein the first microphone array processing component is configured to perform a first set of beamforming operations on the plurality of microphone signals, and wherein the second microphone array processing component is configured to perform a second set of beamforming operations on the plurality of microphone signals.

11. The apparatus of claim 9, further comprising:

a third band analysis filter component configured to generate a third output based on the first microphone array processing signal, wherein the third output corresponds to a second sub-band of the plurality of sub-bands;

a fourth band analysis filter component configured to generate a fourth output based on the second microphone array processing signal, wherein the fourth output corresponds to the second sub-band; and a second adaptive mixing component associated with the second sub-band, wherein the second adaptive mixing component is configured generate a second mixer output associated with the second sub-band based on a comparison of the third output to the fourth output.

12. The apparatus of claim 10, wherein:

the first sub-band corresponds to a first range of frequency values, wherein each frequency value in the first range of frequency values is not greater than about 1 KHz; and the second sub-band corresponds to a second range of frequency values, wherein each frequency value in the second range of frequency values is not less than about 1 KHz.

13. A system comprising:

a plurality of microphones;

a first microphone array processing component configured to generate a first microphone array processing signal based on a plurality of microphone signals received from the plurality of microphones, wherein the first microphone array processing signal is associated with a frequency band that includes a plurality of sub-bands;

a second microphone array processing component configured to generate a second microphone array processing signal based on the plurality of microphone signals received from the plurality of microphones, wherein the second microphone array processing signal is associated with the frequency band that includes the plurality of sub-bands;

a first band analysis filter component configured to generate a first output based on the first microphone array processing signal, wherein the first output corresponds to a first sub-band of the plurality of sub-bands;

a second band analysis filter component configured to generate a second output based on the second microphone array processing signal, wherein the second output corresponds to the first sub-band;

a first adaptive mixing component associated with the first sub-band, wherein the first adaptive mixing component is configured to generate a first adaptive mixer output associated with the first sub-band based on a comparison of the first output to the second output, wherein the comparison is based on the first output having a first signal-to-noise ratio that is higher than a second signal-to-noise ratio of the second output, wherein in response to the first output having a higher signal-to-noise ratio than the second output, the first adaptive mixing component is configured to perform a first set of microphone mixing operations to generate the first adaptive mixer output associated with the first sub-band, and in response to the first output having a lower signal-to-noise ratio than the second output, first adaptive mixing component is configured to perform a second set of microphone mixing operations; and a first synthesis component associated with the first adaptive mixing component, the first synthesis component configured to generate a first synthesized sub-band output signal based on the first adaptive mixer output.

14. The system of claim 13, further comprising:

a third band analysis filter component configured to generate a third output based on the first microphone array processing signal, wherein the third output corresponds to a second sub-band of the plurality of sub-bands;

a fourth band analysis filter component configured to generate a fourth output based on the second microphone array processing signal, wherein the fourth output corresponds to the second sub-band;

a second adaptive mixing component associated with the second sub-band, wherein the second adaptive mixing component is configured generate a second adaptive mixer output associated with the second sub-band based on a comparison of the third output to the fourth output;

a second synthesis component associated with the second adaptive mixing component, the second synthesis component configured to generate a second synthesized sub-band output signal based on the second adaptive mixer output; and a combiner to generate an audio output signal based on a plurality of synthesized sub-band output signals, the plurality of synthesized sub-band output signals including at least the first synthesized sub-band output signal and the second synthesized sub-band output signal.

15. The system of claim 13, wherein the plurality of microphones include at least one omnidirectional microphone and at least one directional microphone, and wherein the plurality of microphones are disposed within a headset.

16. The system of claim 13, wherein the first microphone array processing component is configured to perform a first set of beamforming operations on the plurality of microphone signals, and wherein the second microphone array processing component is configured to perform a second set of beamforming operations on the plurality of microphone signals.

17. A method comprising:

receiving a first microphone array processing signal, wherein the first microphone array processing signal is associated with a frequency band that includes a plurality of sub-bands;

receiving a second microphone array processing signal, wherein the second microphone array processing signal is associated with the frequency band that includes the plurality of sub-bands;

generating a first output based on the first microphone array processing signal, wherein the first output corresponds to a first sub-band of the plurality of sub-bands;

generating a second output based on the second microphone array processing signal, wherein the second output corresponds to the first sub-band of the plurality of sub-bands;

generating a third output based on the first microphone array processing signal, wherein the third output corresponds to a second sub-band of the plurality of sub-bands;

generating a fourth output based on the second microphone array processing signal, wherein the fourth output corresponds to the second sub-band;

performing a first set of microphone mixing operations to generate a first adaptive mixer output associated with the first sub-band;

performing a second set of microphone mixing operations to generate a second adaptive mixer output associated with the second sub-band, wherein the second set of microphone mixing operations is different from the first set of microphone mixing operations;

comparing the first output to the second output;

in response to the first output having a higher signal-to-noise ratio than the second output, performing the first set of microphone mixing operations to generate the first adaptive mixer output associated with the first sub-band; and in response to the first output having a lower signal-to-noise ratio than the second output, performing the second set of microphone mixing operations.

18. The method of claim 17, wherein the first microphone array processing signal is a result of a first set of beamforming operations performed on a plurality of microphone signals received from a plurality of microphones.

19. The method of claim 18, wherein the second microphone array processing signal is a second result of a second set of beamforming operations performed on the plurality of microphone signals received from the plurality of microphones.

20. The method of claim 19, wherein the first set of beamforming operations includes one or more omnidirectional microphone beamforming operations, and wherein the second set of beamforming operations includes one or more directional microphone beamforming operations.

* * * * *